United States Patent [19]

Brochier et al.

[11] 4,107,020

[45] Aug. 15, 1978

[54] VERTICAL ELECROLYTIC CELLS

[75] Inventors: Michel Brochier, Grenoble; Maurice Pichon, Decines, both of France

[73] Assignee: Commissariat a l'Energie Atomique, Paris, France

[21] Appl. No.: 763,633

[22] Filed: Jan. 28, 1977

[30] Foreign Application Priority Data

Jan. 30, 1976 [FR] France ..... 76 03017

[51] Int. Cl.[2] ..... C25B 11/18; C25B 9/00; C25B 1/38

[52] U.S. Cl. ..... 204/251; 204/220; 204/274

[58] Field of Search ..... 204/251, 250, 219, 220, 204/99, 274

[56] References Cited

U.S. PATENT DOCUMENTS

| | | | |
|---|---|---|---|
| 784,592 | 3/1905 | Phillip | 204/219 |
| 789,721 | 5/1905 | Decker | 204/219 |
| 1,970,975 | 8/1934 | Palmaer et al. | 204/219 X |
| 3,408,281 | 10/1968 | Barnard et al. | 204/219 |

*Primary Examiner*—John H. Mack
*Assistant Examiner*—D. R. Valentine
*Attorney, Agent, or Firm*—Ostrolenk, Faber, Gerb & Soffen

[57] ABSTRACT

A vertical electrolytic cell has an anode separated from a cathode by a diaphragm. The cathode comprises continuous threads of mercury flowing down by gravity from evenly distributed apertures in the bottom wall of at least one channel fed with mercury.

18 Claims, 5 Drawing Figures

66
64
62
76
78
74
87
46
56
42
82
54
46
44
50
48
48
40
52
88
52
84
86
58
72
68
56
80
60
74A
52A
54A
48
54
80
68
80

150
148
126
154
156
141
140
120
146
156
144
152
142
124
150
148
146A
122
154
141
140
128
136
102
132
134
138
146

VERTICAL ELECROLYTIC CELLS

BACKGROUND AND SUMMARY OF THE INVENTION

The invention relates to electrolytic cells whose cathode comprises a vertical flow of mercury. Such electrolytic cells have already been used, for instance in the preparation of chlorine. The cathode consists of a film of mercury which flows along a vertical wall. While such an electrolytic cell is advantageous, since the horizontal surface required for locating it is small, it has attendant drawbacks: the area of cathode surface per unit flow of mercury is low.

The inventory of mercury used in these installations is consequently large and at least as great as those used in "horizontal" electrolysers. Moreover, a risk of contamination of the electrolytes exists if the wall which supports the mercury film contains metal.

In another prior art electrolyser (French Pat. No. 352,029), the mercury is received in channels located above each other and runs downwardly by overflows. Then, the cathode surface essentially consists of the free level of mercury in the channels and the ratio between the surface area and the inventory of mercury is low.

It is an object of the invention to provide an improved vertical electrolytic cell, having an increased active cathode area for a given amount of mercury inventory.

It is another object of the invention to provide a vertical electrolytic cell in which the risk of contamination is substantially reduced.

It is a more specific object of the invention to provide an electrolytic cell which is particularly adapted to the reduction of uranium ions in an aqueous solution.

According to an aspect of the invention, there is provided an electrolytic cell having cathode means and anode means, wherein said cathode means comprises at least one continuous thread of mercury flowing down by gravity from an aperture in the bottom wall of at least one channel.

Generally, the electrolytic cell comprises a casing and vertical diaphragm means separating an anode compartment locating said anode means having a vertical surface and a cathode compartment locating said cathode means in said casing.

The vertical diaphragm may be impervious to liquids and gases, and permeable to ions. Any ingress of one electrolyte into the other is then prevented. However, pervious diaphragms may also be used.

The size of the apertures in the bottom of the channel or channels should be selected for the mercury threads to remain continuous, at least when a voltage is applied to the electrolytic cell. Typically, for the mercury threads to remain continuous, they are given a diameter which does not exceed about 5 mm and their free length should not exceed about 15 cm from the outlet aperture up to the channel or that which receives them. It is of interest to note that the mercury thread becomes fractioned in droplets when no voltage is applied to the electrolytic cell, due to the oxidation of mercury. Oxidation is not present any longer when electrolysis occurs. From a first consideration, it would consequently appear that it would be impossible to carry out the invention, because it apparently leads to use mercury threads having such a diameter that the approach would be irrealistic.

It appears clearly that the active surface of the cathode is substantially increased with respect to that of a mercury sheet running down a metal support and the risk of pollution is removed.

According to a first embodiment of the invention, the electrolytic cell is rectangular and comprises an anode compartment in the form of a parallelepiped filled with anolyte and equipped with an anode, a plane diaphragm and a cathode compartment in the form of a parallelepiped filled with catholyte, through which compartment descend continuous streams of mercury constituting the cathode. The electrolyser may comprise a plurality of anodic and cathodic parallelepipedal compartments separated by plane diaphragms and arranged side by side in the manner of the cells of a filter press.

According to a second embodiment, the electrolytic cell is cylindrical and comprises an anode compartment filled with anolyte and equipped with a tubular anode, a tubular diaphragm and an annular cathode compartment filled with catholyte through which flow the continuous streams of mercury which constitute the cathode. Again, an electrolyser may comprise a plurality of anode and cathode compartments separated by diaphragms. Typically, a single, large anode compartment is provided, which is filled with anolyte in which a plurality of units are assembled, each comprising a tubular anode, a tubular diaphragm and an annular cathode compartment filled with catholyte.

When an electrolyser has several cells, the electric connections may be either in series or in parallel or in series parallel.

The catholyte may be supplied either in series or in parallel but each compartment has its own independent circulation of mercury for preventing short-circuits.

In order to maintain electrolysis, the streams of mercury which form the cathode must flow continuously so that the path of electric current will not be cut off. The length of the mercury threads and the size of the apertures (which are preferably, but not necessarily circular in shape) are determined in dependence of various factors, in particular the voltage applied to the terminals of the electrolytic cell and the nature, concentration and rate of flow of the electrolytes.

The or each cathode compartment may contain a plurality of channels fixed one above the other to a support, the highest channel being supplied with mercury. Each channel has apertures in its bottom wall through which the continuous streams of mercury flow. Each channel, except the first, is supplied with the continuous stream of mercury from the channel above it.

The channels may be secured to a support made of a conductive material having a sufficient overvoltage (for example graphite). This arrangement results in an electrolytic cell with a double cathode, a mercury cathode formed by the continuous streams of mercury and a second cathode consisting of the conductive support.

The channels may be made of a conductive material and connected to the electric supply. Alternatively, they may be made of an insulating material, in which case means must be provided to conduct the electric current to the mercury contained in them. The choice of materials used for the electrolytic cell, the anode, the compartments, the channels, the diaphragm and the electric connections will depend on the results to be obtained and the nature of the compounds to be treated.

The anodes and/or the supports for the channels may have internal cavities located in the path of a cooling fluid, for example water. This arrangement enables the electrolytic cell to be cooled in situ so that the external heat exchangers otherwise required for cooling the electrolytes and mercury can be dispensed with and hence the quantity of mercury used can be further reduced. The internal cavities may as well or in addition locate pumps for the circulation of mercury and/or of the electrolytes.

The invention will be better understood from a consideration of the following description of particular embodiments given by way of non-limitative examples. The description refers to the accompanying drawings which illustrate only those elements which are necessary for an understanding of the invention.

SHORT DESCRIPTION OF THE DRAWINGS

DESCRIPTION OF PREFERRED EMBODIMENTS

Figure 1:
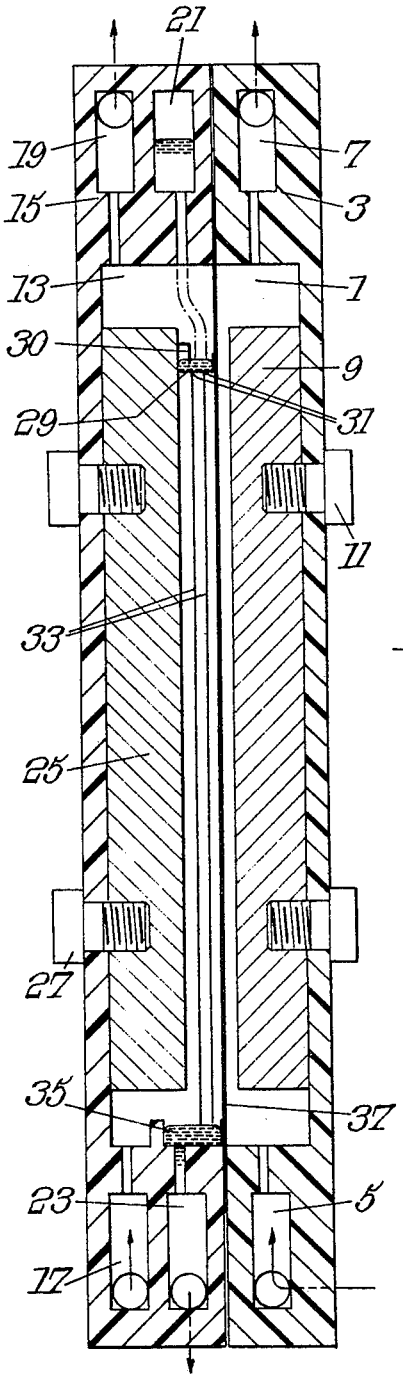
FIG. 1 is a vertical cross-section through an elementary rectangular electrolytic cell.

The vertical electrolytic cell represented in FIG. 1 comprises parts which will be described in succession.

An anode compartment 1 is limited by a plastic housing 3. Cavities 5 and 7 formed in the housing serve, respectively, for the inlet of anode liquid or anolyte and for the discharge of the mixture of anode liquid and gas produced during electrolysis. Compartment 1 contains a graphite anode 9 fixed to the housing 3 by screws 11 which may be used for conducting electric current to the anode from the positive terminal of a D.C. source (not shown).

A cathode compartment 13 is also formed by a housing 15 of plastics material. Four cavities are formed in housing 15. Cavities 17 and 19 are, respectively, for the inlet of cathode liquid or catholyte and for the discharge of a diphasic mixture of cathode liquid and gas produced during electrolysis. The cavities 21 and 23 are provided for inflow and discharge of mercury, respectively. A graphite support 25 fixed to the housing 15 by screws 27 supports a channel 29 made of plastic material, typically polyvinyl chloride, which contains mercury in operation. The bottom wall of channel 29 has apertures 31 through which streams of mercury flow, two of which are shown at 33. These streams of mercury constitute the mercury cathode. The mercury collects in a vat 35 before being discharged at 23. Electric current may be transmitted to the mercury in channel 29 by a graphite contact element 30.

A diaphragm 37 clamped between housings 3 and 15 separates compartments 1 and 13.

The electrolytic cell illustrated in FIG. 1 is adapted for numerous uses. Generally, the anolyte and catholyte will both be aqueous solutions and it may be necessary to use an impervious diaphragm for preventing mixing which would otherwise result from the pressure differential across the diaphragm due to the head-losses. Then, the diaphragm should be pervious to ions. An ion exchange diaphragm will generally be used, for instance a diaphragm of IONAC NA 3475.

Generally, the fluid discharged from the cavities 7 and 19 will comprise liquid and gas. Phase separators (not shown) may be located on outlet pipes originating from cavities 7 and 19 for separating the electrolyte (anolyte or catholyte) and the trapped gas.

Heat exchangers (not shown) may be provided along the pathways of the electrolytes and of mercury, outside the electrolytic cell, to cool them. For decreasing the hold up of mercury, the thickness of the mercury layer in each channel should be as low as possible. On the other hand, the thickness should be sufficient for continuous threads to be delivered over the whole free length of the threads. Generally, the free length will not exceed 15 cm if the catholyte is an aqueous solution which flows upwardly at a speed of some cm/sec. The apertures are typically identical, of circular shape and distributed along one, two or three circular rows parallel to the diaphragm. The distance between adjacent apertures will typically be less than or equal to the diameter of the apertures.

For increasing the vertical size of the electrolytic cell, two or more channels may be provided at different levels. Each channel, except the first, is supplied with mercury from the channel above it.

Figure 2:
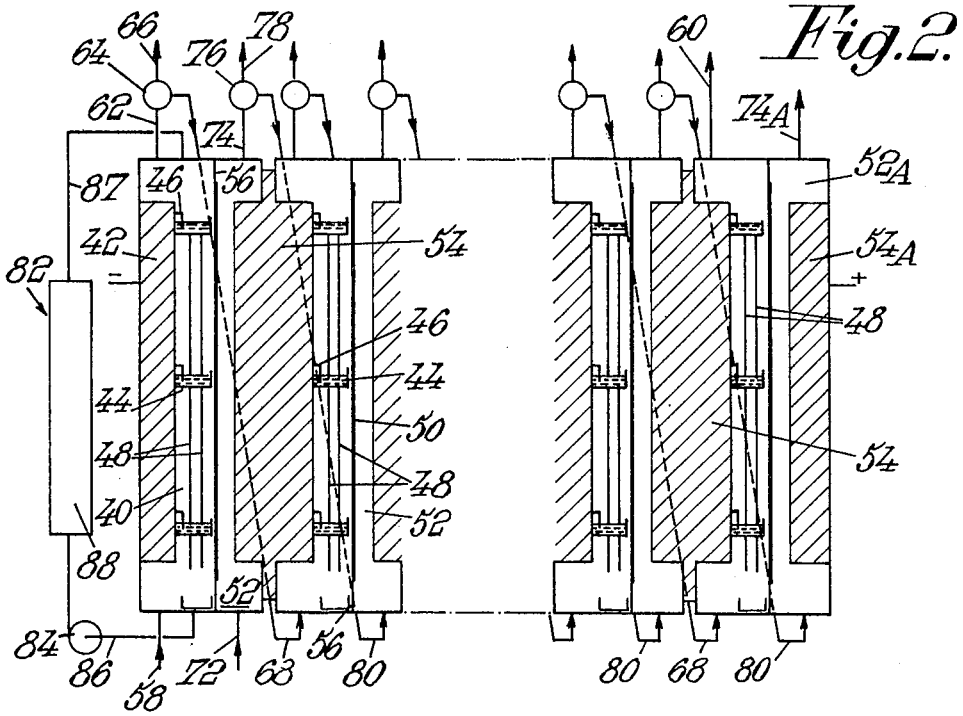
FIG. 2 is a vertical cross-section of an assembly of rectangular electrolytic cells of the type shown in FIG. 1.

Referring to FIG. 2, there is shown a multiple electrolyser whose cathode compartments 40 locate graphite supports 42 connected by conductor means (not shown) to the negative terminal of an electric generator. Each support 42 carries three channels 44 of polyvinyl chloride. Graphite elements 46 fixed to the supports dip into a mercury layer received in the channels and provide for the passage of electric current. Mercury flows out of the channels through apertures in the bottom walls thereof in the form of continuous streams 48. Diaphragms 50 (e.g. of IONAC 3475) separate the cathode compartments 40 from adjacent anode compartments 52 in which anodes 54 are placed. If the electrolyte cells are connected in series, some of the graphite supports 40 can operate as an anode for one anode compartment and as a cathode for the adjacent cathode compartment. The supports 42 are mounted on liquid tight walls 56 which separate adjacent compartments. If necessary, the graphite may be given properties which are different on the side limiting the cathode compartment and the side limiting the anode compartment.

Catholyte is delivered to the first cathode compartment of the electrolyser at 58. After it has been processed, it leaves in the form of a gas/liquid emulsion through pipes 62. Phase separators 64 separate the gas, for example hydrogen, which is removed at 66, from the catholyte which is carried to the following cathode compartment along conduit 68. The catholyte thus traverses the whole electrolyser and is finally discharged from it at 60.

Anolyte is delivered to the first anode compartment 52 by pipe 72. After it has flowed across compartment 52 it is transferred in the form of a gas/liquid emulsion to phase separators 76 along pipes 74. The gases produced during electrolysis are discharged at 78 while the anolyte is transferred to the following anode compartment via a conduit 80. The anolyte continues to circulate until it reaches the last anode compartment 52A from which it is discharged at 74A. Compartment 52A contains an anode 54A connected to the positive terminal of the electrical source.

In order to eliminate the possibility of short circuiting, each cathode compartment has its own circulation of mercury only one of which is represented at 82. Mercury is removed from the bottom of the cell by a pump 84 along pipe 86 and is then recycled to the upper part of the compartment via pipe 87. A heat exchanger 88 removes the heat produced by electrolysis.

Figure 3:
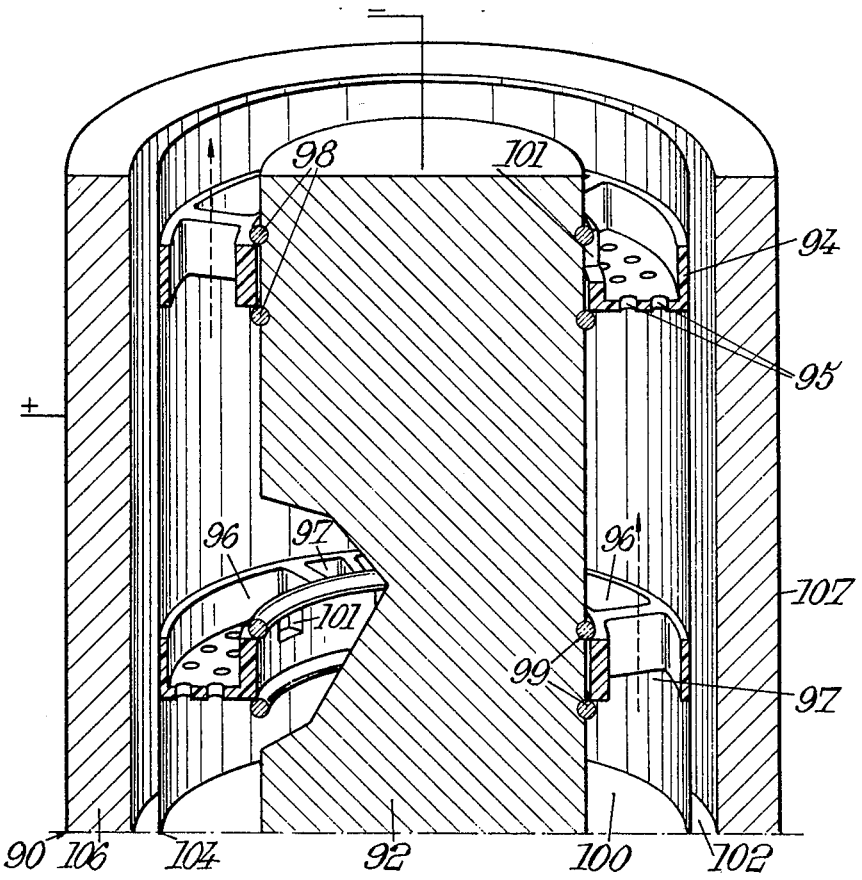
FIG. 3 is a vertical cross-section through part of a cylindrical electrolytic cell.

Referring to FIG. 3, there is shown part of an electrolytic cell 90 whose upper cover equipped with feed pipes and discharge pipes for fluids and electric terminals has been removed for the sake of clarity. The cell is also shown without mercury. Cell 90 comprises a cylindrical core 92 made of graphite connected to the negative terminal of a D.C. source. The graphite core 92 supports annular channels 94 made of polyvinyl chloride. These channels 94 are filled with mercury when the cell is in operation and they are formed with two types of apertures, namely circular apertures 95 through which threads of mercury flow in operation, and apertures 97 which enable the mixture of catholyte and gas to flow upwards. The apertures 95 are formed through the bottom wall of a trough or channel 96 which contains mercury when the cell is in operation. The positions of the various apertures are chosen so as to provide optimum contact between the catholyte and mercury. These channels are retained on the support 92 by O-ring seals 98, for instance of PTFE, seated in grooves 99 machined out of the core 92. Radial apertures 101 enable the mercury to flow towards the core 92. The space delimited by the core 92, the channel 94 and the seals 98 is thus filled with mercury, thereby ensuring contact between the core 92 and the mercury in the channels 94. The annular cathode compartment 100 is separated from the annular anode compartment 102 by a tubular diaphragm 104 which contacts the channels 96. Diaphragm may be of the ion exchanger material known as IONAC NA 3475. A tubular anode 106 reinforced by a metal body 107 connected to the positive terminal of the D.C. source completes the electrolytic cell.

Figure 4:
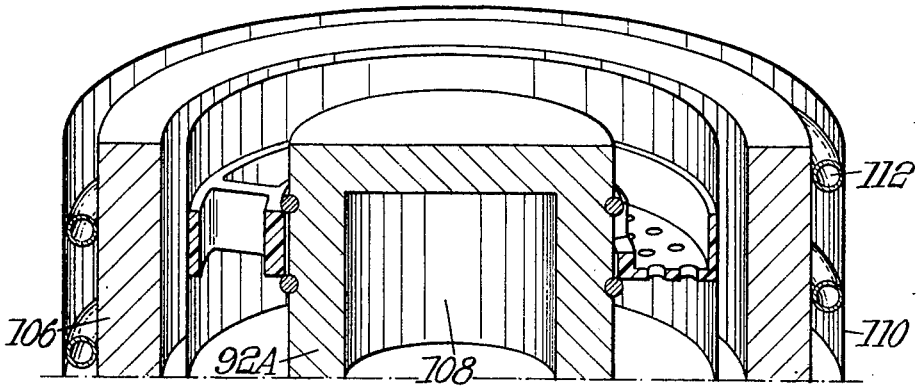
FIG. 4 is a vertical cross-section of an electrolytic cell similar to that of FIG. 3 equipped with heat exchangers.

Referring to FIG. 4, there is shown a cylindrical electrolytic cell similar to that of FIG. 3, but with heat exchangers incorporated therein.

The cylindrical core 92A is hollow. A cooling liquid is delivered to and flown out of the cavity 108 by pipes (not shown) and circulates through the cavity 108. A tubular metal casing 110 fitted with a pipe 112 through which a cooling liquid circulates contacts the anode 106. The heat produced by electrolysis is thereby evacuated in situ so that external heat exchangers and their accessories (pumps, valves, etc.) can be dispensed with and the hold-up of mercury may be considerably reduced.

Figure 5:
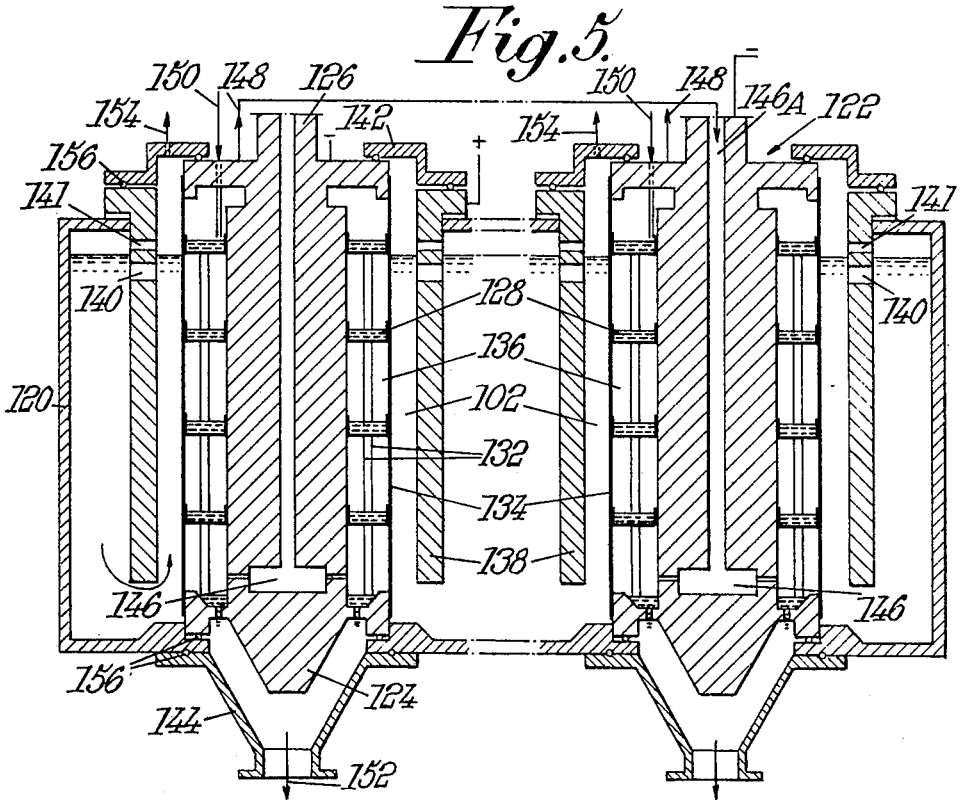
FIG. 5 is a view of an electrolytic assembly composed of cylindrical electrolytic cells.

Referring to FIG. 5, there is shown an electrolyser comprising a large tank 120 which limits an anode compartment 102 in which several cylindrical assemblies or units 122, each having an annular cathode compartment, a tubular diaphragm and a tubular anode, are placed. Two such assemblies are illustrated.

Each unit 122 comprises a cylindrical graphite core 124 connected to a negative potential by terminals 126. The core supports channels 128 of PVC which in operation contain mercury. Electrical current is passed-from the core 126 to mercury as in the previous example. Continuous streams of mercury 132 operating as a cathode flow out through perforations in the bottom walls of the channels 128. A tubular diaphragm 134 (e.g. of ion exchanger IONAC NA 3475) separates the cathode compartment 136 from the anode compartment 102. Each assembly is completed by a tubular graphite anode 138 surrounding the diaphragms and electrically connected to the tank 120. Apertures 140 and 141 in the anodes provide for the circulation of anolyte and of the gases, respectively. Pump means (not shown) may be provided to accelerate circulation of the anolyte.

Each diaphragm 134 is fixed at its upper end to a cover 142 of the corresponding unit 122 and at its lower end to a truncated cone shaped surface 144, the function of which will be explained later.

The electrolyser operates as follows:

The catholyte enters the cathode compartment 136 through a passage 146 formed in the graphite core 124. After processing in the cathode compartment, the resulting diphasic mixture is first carried along 148 to a phase separator (not shown) and then it is either removed for use or carried to the cathode compartment along 146A. In the cathode compartment, the catholyte contacts the threads of mercury 132 travelling in countercurrent to it. The mercury enters the installation at 150 and then collects in the truncated cone shaped parts 144 before being discharged at 152. After the mercury has been cooled, and if necessary regenerated, it is recycled via 150. The gases produced in the anolyte in the course of electrolysis are evacuated at 154. O-ring seals 156 are provided to seal the apparatus where necessary.

The electrolyser represented in FIG. 5 is easily maintained since it is easily dismantled. All that is necessary is to lift off the cover 142 to reach access to a defective component and replace it.

Internal cooling means such as those represented in FIG. 4 may again be used.

Electrolytic cells as described above may be used for preparation of uranium III chloride with a yield close to 100%, starting from $UCl_4$ or $UCl_6$. As indicated in French Pat. No. 2,282,928, to which reference may be made, $U^{3+}$ is stable in an aqueous solution only if the solution is free from oxidizing substances and metals of Groups III to VIII of the Periodic Table. Any part of the apparatus liable to come into contact with the uranium solution must be made of a material other than metal or covered with insulating material. (except for the cathode).

The electrolytic installation, 70 cm in height and 30 cm in width, is composed of two cells connected in series.

Each cathode compartment has nine channels placed one above the other, each formed with 68 apertures 0.25 cm in diameter. The surface area of the cathode produced by the 1224 threads of mercury thereby obtained is 5765 $cm^2$. The channels are fixed to flat supports made of graphite, the effective surface area of which is about 2782 $cm^2$ for an assembly of two cells. Ion exchanger diaphragms IONAC NA 3475 separate the two cathode compartments from the two anode compartments. Each anode compartment has a graphite anode having a surface area of 1391 $cm^2$ so that the total effective anode surface area is 2782 $cm^2$. The distance between cathode and diaphragm is about 5 mm and the distance between anode and diaphragm is 7 mm. The electrolyser is supplied with a cathode aqueous solution containing 1 M of $UCl_4$. The solution was an aqueous 2N HCl solution and the rate 30 liters per hour. $UCl_4$ is quantitatively converted into $UCl_3$ by the time the catholyte is discharged from the electrolytic installation after it has passed successively through the two cathode compartments.

The anode compartments are in series relation and supplied with an aqueous 6N HCl solution containing approximately 0.02 M of uranyl chloride, at a rate of 200 liters per hour.

The following current densities and potentials are maintained during electrolysis:

| | |
|---|---|
| Current density in mercury | = 0.13 A/cm$^2$ |
| Current density across diaphragm | = 0.3 A/cm$^2$ |
| Current density on anode | = 0.3 A/cm$^2$ |
| Cathode: electrochemical potential + cathodic overvoltage | = 1 V |
| Voltage drop in catholyte | = 0.5 V |
| Voltage drop in diaphragm | = 0.7 V |
| Voltage drop in anolyte | = 0.2 V |
| Anode : electrochemical potential + anodic overvoltage | = 1.4 V |

The total voltage for one cell is therefore 3.8 volts.

Other uses are obviously possible: for instance, a diaphragm-free electrolyser may be used for preparing lithium amalgam by electrolysis of LiOH. Then a $H_2$—$O_2$ mixture is also obtained. Due to the $O_2$ presence on the anode, graphite cannot be used and will be replaced by a metal, such as nickel, for constituting the anode.

We claim:

1. A vertical electrolytic cell having cathode means and anode means, wherein said cathode means comprises a substantially horizontal channel provided with a bottom wall having a plurality of apertures located above an unobstructed space, means for delivering mercury to said channel and means for collecting mercury flowing down by gravity from said apertures and directing said mercury out of said cell, the size of said apertures being such that mercury flows as continuous threads from said apertures throughout said space.

2. Electrolytic cell according to claim 1, comprising a casing and vertical diaphragm means separating an anode compartment locating said anode means which has a vertical surface and a cathode compartment locating said cathode means in said casing.

3. Electrolytic cell according to claim 2, wherein said cathode compartment comprises a plurality of said channels placed one above the other, the bottom wall of said channels being formed with a plurality of said apertures through which the continuous streams of mercury flow, each channel except the highest channel being supplied with continuous threads of mercury from the channel above it and means being provided for delivering mercury to the highest channel and collecting mercury flowing out of the lowest channel.

4. Electrolytic cell according to claim 2, wherein said casing is of parallelepipedic shape, said anode compartment is in the form of a vertically elongated parallelepiped, said diaphragm means is planar and said cathode compartment is in the form of a vertically elongated parallelepiped, and wherein means are provided for circulating liquid electrolytes vertically through said compartments.

5. Electrolytic cell according to claim 4, having a plurality of said anode and cathode compartments separated by planar diaphragms and placed side by side.

6. Electrolytic cell according to claim 2, wherein said diaphragm is tubular and is located between a radially inner cathode and a radially outer tubular anode having means for flowing respective electrolytes vertically through said compartments.

7. Electrolytic cell according to claim 2, having a single anode compartment, in which is arranged a plurality of assemblies each comprising a tubular anode, a tubular diaphragm and an annular cathode compartment.

8. Electrolytic cell according to claim 2, wherein said diaphragm is permeable.

9. Electrolytic cell according to claim 2, wherein said diaphragm is impervious and is formed of ion exchange material.

10. Electrolytic cell according to claim 6, wherein said channel is of annular shape and the apertures are distributed along no more than three concentric circular rows.

11. A vertical electrolytic cell for electrolytic reduction of uranium ions and the like, comprising:

an electrically insulating casing, vertical diaphragm means separating an anode compartment and a cathode compartment in said casing;

cathode means located in said cathode compartment and comprising a channel located in the upper zone of said cathode compartment and having a bottom wall formed with a plurality of regularly distributed apertures;

anode means located in said anode compartment and having a vertical surface substantially parallel to said diaphragm means;

means for causing an electrolysis current to flow from said anode means to said cathode means;

means for circulating an aqueous acid solution of said uranium ions vertically across said cathode compartment;

means for circulating a liquid anolyte vertically across said anode compartment; and means for delivering mercury to said channel and collecting mercury flowing out of said channel through the bottom apertures thereof, the cross-sectional area of said apertures, the head of mercury and the distance between said channel and the mercury collecting means being selected for mercury to flow down by gravity in the form of continuous threads from said channel to the collecting means.

12. Electrolytic cell according to claim 11, wherein said apertures are of circular shape.

13. Electrolytic cell according to claim 12, wherein the distance between the apertures is at most equal to the diameter of the mercury threads delivered by the apertures.

14. Electrolytic cell according to claim 12, wherein the vertical distance between the bottom wall of said channel and the collecting means is at most equal to 15 cm.

15. A vertical electrolytic cell having cathode means and anode means, wherein said cathode means comprises a plurality of channels placed one above the other, the bottom wall of each of said channels being formed with at least one aperture, means for delivering mercury to the highest channel and collecting mercury flowing out of the lowest channel, each channel except the highest channel being located for receiving mercury from the channel above it in operation and the size of said apertures and the vertical distance between said channels being such that mercury flows out of each aperture into the channel under it as a continuous thread.

16. Electrolytic cell according to claim 15, wherein said channels are fixed to a conductive support connectable to the negative terminal of a D.C. source.

17. Electrolytic cell according to claim 16, wherein the anode and the support for the channels have internal cavities and means are provided for flowing a liquid coolant through said cavities.

18. Electrolytic cell according to claim 16, wherein the anode and the support for the channels have internal cavities and pumps for circulating the electrolytes and mercury are located in said cavities.

* * * * *